US010259551B2

(12) United States Patent
Veikonheimo

(10) Patent No.: US 10,259,551 B2
(45) Date of Patent: Apr. 16, 2019

(54) PROPULSION UNIT

(71) Applicant: ABB Oy, Helsinki (FI)

(72) Inventor: Tomi Veikonheimo, Helsinki (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 15/350,082

(22) Filed: Nov. 13, 2016

(65) Prior Publication Data

US 2017/0233049 A1 Aug. 17, 2017

Related U.S. Application Data

(63) Continuation of application No. PCT/FI2015/050313, filed on May 8, 2015.

(30) Foreign Application Priority Data

May 14, 2014 (EP) ..... 14168218

(51) Int. Cl.
*B63H 5/15* (2006.01)
*B63H 21/17* (2006.01)
*B63H 5/125* (2006.01)

(52) U.S. Cl.
CPC ..... *B63H 5/15* (2013.01); *B63H 5/125* (2013.01); *B63H 21/17* (2013.01); *B63H 2005/1254* (2013.01); *B63H 2005/1258* (2013.01)

(58) Field of Classification Search
CPC ..... B63D 5/15; B63D 5/125; B63H 21/17; B63H 2005/1254; B63H 2005/1256; F03D 9/008
See application file for complete search history.

(56) References Cited

U.S. PATENT DOCUMENTS 4,580,517 A * 4/1986 Lundberg ..... B63H 5/08 114/144 R
6,062,925 A * 5/2000 Salmi ..... B63B 35/08 114/40

(Continued)

FOREIGN PATENT DOCUMENTS

DE 3735409 A1 * 5/1989 ..... B63H 5/125
FI 79991 B 12/1989

(Continued)

OTHER PUBLICATIONS

DE 3735409, Specification English Translation, Espacenet.*

(Continued)

*Primary Examiner* — Jason D Shanske
*Assistant Examiner* — John S Hunter, Jr.
(74) *Attorney, Agent, or Firm* — J. Bruce Schelkopf; Taft Stettinius & Hollister LLP

(57) ABSTRACT

A support strut has an upper end rotatable supported at a bottom of a vessel and a lower end supporting a casing. A first electric motor within the casing drives a propeller via a first shaft. An annular nozzle surrounds an outer perimeter of the propeller and is fixedly supported on the casing, with a support construction comprising at least three vanes extending in the radial direction between the outer perimeter of the casing and the inner perimeter of the nozzle. A duct for water flow is formed through the interior of the annular nozzle. The propeller pulls the vessel in a driving direction. The vanes are positioned after the propeller in the driving direction of the vessel, whereby the vanes are optimized for redirecting rotational flow components of the flow produced by the propeller into axial thrust.

23 Claims, 5 Drawing Sheets

(56) References Cited

U.S. PATENT DOCUMENTS

| | | | | |
|---|---|---|---|---|
| 2003/0000444 | A1* | 1/2003 | Tsuboguchi ..... | B63H 5/125<br>114/162 |
| 2008/0194155 | A1 | 8/2008 | Gaudin | |

FOREIGN PATENT DOCUMENTS

| | | | |
|---|---|---|---|
| FI | 107040 | B | 5/2001 |
| JP | 2965974 | B1 | 10/1999 |
| JP | 2001516675 | A | 10/2001 |
| JP | 20015166675 | A | 10/2001 |
| WO | 9914113 | A1 | 3/1999 |

OTHER PUBLICATIONS

Performance evaluation of an underwater body and pumpjet by model testing in cavitation tunnel, Ramji et. al., JNAOE, vol. 2 Issue 2, Jun. 2010, pp. 57-67, PDF of only the instant article.*

Internationai Search Report, PCT/FI2015/050313, ABB Oy, Aug. 24, 2015, 5 pages.

International Preliminary Report on Patentability, PCT/FI2015/050313, ABB Oy, Jun. 15, 2016, 17 pages.

* cited by examiner

PROPULSION UNIT

FIELD OF THE INVENTION

The present invention relates to a propulsion unit comprising a support strut extending downwards from a hull of a vessel, a casing attached to a lower end of the support strut, a propeller being arranged to an end of the casing, and an annular nozzle surrounding the outer perimeter of the propeller blades and being fixedly supported on the casing with a support construction comprising at least three vanes between an outer perimeter of the casing and an inner perimeter of the nozzle, said nozzle having an inlet opening and an outlet opening, whereby a duct for water flow is formed between the inlet opening and the outlet opening through the interior of the annular nozzle.

BACKGROUND ART

WO patent publication 99/14113 discloses a propulsion system for vessels and a method for moving a vessel in ice conditions. The system comprises a drive shaft, a propeller attached to the drive shaft, and a nozzle surrounding the propeller. The nozzle has a water inlet and a water outlet, and rotatable blades or vanes attached to a portion of the drive shaft which projects outside the water inlet for breaking and or crushing ice before the ice enters the nozzle. The point of maximum diameter of the blades or vanes is positioned at an axial distance from the plane of the water inlet which is 0.02 to 0.25 times the diameter of the propeller. The diameter of the rotatable blades or vanes is 0.6 to 0.8 times the diameter of the propeller.

U.S. Pat. No. 2,714,866 discloses a device for propelling a ship. The motor casing is in the embodiment shown in FIG. 4 attached to a vertical rudder shaft and can thereby be turned with the rudder shaft from the interior of the ship. An electric motor is positioned within the motor casing. A nozzle surrounding the casing is supported with flat joint pieces on the casing. The pulling propeller which is driven with the electric motor is positioned at the front end of the casing within the nozzle. The flat joint pieces are slightly bent so that they capture the helical motion of the water coming from the propeller. This causes the helical motion component of the resultant speed of the water stream to change to an axial direction and to be employed for shearing.

U.S. Pat. No. 8,435,089 discloses a marine engine assembly including a pod mountable under a ship's hull. The marine propulsion set comprises at least one pod that is mechanically connected to a support strut, a propeller that is situated at the aft end of the pod and that has at least two blades, and an arrangement of at least three flow-directing fins that are fastened to the pod. This arrangement of fins forms a ring that is substantially perpendicular to the longitudinal axis of the pod, said ring lying within a zone that is situated between a central portion of said support strut and the propeller. The propulsion set comprises further a nozzle that surrounds, at least in part, the propeller and said ring. Each of said blades presents an end with an edge coming flush with the inside wall of the nozzle so that the propeller constitutes the rotor of a screw pump. The fins are positioned before the propeller in the normal direction of travel of the ship. There are no fins after the propeller.

Nozzles are used e.g. in so called Dynamic Positioning (DP) vessels used in oil drilling. The nozzle forms a central duct with an axial flow path for water from a first end to a second end of the nozzle. The thrust produced by the propeller is amplified by the nozzle at low speeds. The nozzle may produce up to 40% of the total thrust at low speeds, whereby the propeller produces 60% of the total thrust. There are several propulsion units in such vessels and the vessel is kept steady in position by the propulsion units. A big thrust is thus needed at low speed in order to keep the vessel continuously in position in rough seas.

BRIEF DESCRIPTION OF THE INVENTION

An object of the present invention is to achieve an improved propulsion unit.

The propulsion unit according to the invention is characterized by a support strut extending downwards from a hull of a vessel, a casing attached to a lower end of the support strut, a propeller being arranged to an end of the casing, and an annular nozzle surrounding the outer perimeter of the propeller blades and being fixedly supported on the casing with a support construction comprising at least three vanes between an outer perimeter of the casing and an inner perimeter of the nozzle, said nozzle having an inlet opening and an outlet opening, whereby a duct for water flow is formed between the inlet opening and the outlet opening through the interior of the annular nozzle.

In an aspect, there is provided a propulsion unit comprising a support strut extending downwards from a hull of a vessel, a casing attached to a lower end of the support strut, a propeller being arranged to an end of the casing, an annular nozzle surrounding the outer perimeter of the propeller blades and being fixedly supported on the casing with a support construction comprising at least three vanes between an outer perimeter of the casing and an inner perimeter of the nozzle, said nozzle having an inlet opening and an outlet opening, whereby a duct for water flow is formed between the inlet opening and the outlet opening through the interior of the annular nozzle. The propeller pulls the vessel in a driving direction, the water enters the blades of the propeller freely from the inlet opening of the nozzle, and the support construction of the nozzle is positioned fully inside the nozzle and after the propeller in the driving direction of the vessel, the support construction being positioned between the propeller and the support strut.

In an embodiment, the propulsion unit comprises:

a support strut extending downwards from a hull of a vessel, an upper end of the support strut being rotatable supported at a bottom portion of the hull, a casing attached to a lower end of the support strut, a first electric motor being positioned within the casing, a hub attached to a first end of the casing, a first shaft having a first end attached to the first electric motor and a second end attached to the hub, a propeller comprising at least three blades being attached to the hub, an annular nozzle surrounding the outer perimeter of the propeller blades and being fixedly supported on the casing with a support construction comprising at least three vanes extending in the radial direction between the outer perimeter of the casing and the inner perimeter of the nozzle, said nozzle having an inlet opening and an outlet opening, whereby a duct for water flow is formed between the inlet opening and the outlet opening through the interior of the annular nozzle.

In an embodiment, the propulsion unit is characterized in that:

the propeller pulls the vessel in a driving direction, the support construction of the nozzle is positioned after the propeller in the driving direction of the vessel, whereby the vanes in said support construction are optimized for redirecting rotational flow components of the flow produced by the propeller into axial thrust.

The support construction of the nozzle is positioned after the propeller in the driving direction of the vessel. This means that the spiral shaped flow produced by the propeller will pass through the support construction. The format, the position, the angle and the number of the vanes can be optimized in view of redirecting as much as possible of the rotational components of the propeller flow into axial thrust.

BRIEF DESCRIPTION OF THE DRAWINGS

In the following the invention will be described in greater detail by means of preferred embodiments with reference to the attached drawings, in which.

DETAILED DESCRIPTION OF THE INVENTION

The invention will in the following be disclosed by referring to some embodiments. The embodiments relate to a propulsion unit of a ship/vessel.

In an embodiment, the propulsion unit is an electric azimuth thruster, where an electric motor is arranged to an underwater pod unit directly connected to a propeller. The electricity for the electric motor may be produced by a prime move, such as a gas or diesel engine onboard.

In another embodiment, the propulsion unit is an azimuth mechanical thruster. In this embodiment, the motor is arranged inside the ship, and is connected to the propulsion unit by gearing. The motor may be a diesel motor, an electric motor or a combination thereof. The shaft arrangement may be of L- or Z-type.

In still another embodiment, the propulsion unit may be rotationally fixed, that is non-rotatable. In such an embodiment there is provided an additional rudder for controlling the orientation of the ship. The motor may be an electric motor arranged to an underwater pod or onboard, that is inside the ship, or a mechanical thruster arranged onboard.

In the following the invention will be explained by reference to an embodiment where the propulsion unit has an electric motor arranged to an underwater pod unit but it is understood that the disclosed concept relating to a nozzle and the related features such as the propeller and the vanes is not dependent on where and how the propulsion power is produced.

Figure 1:
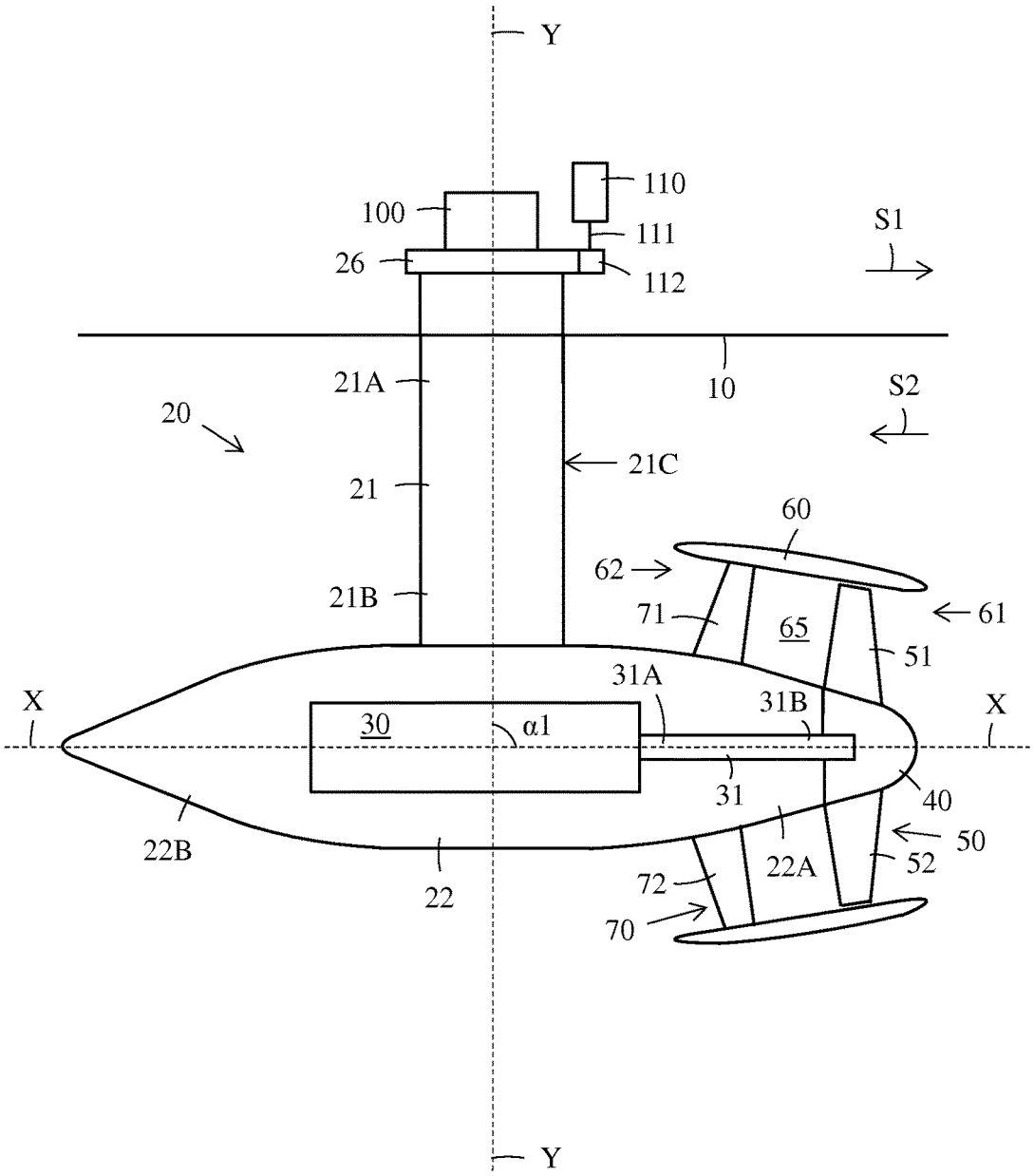
FIG. 1 shows a vertical cross section of a propulsion unit according to the invention.

FIG. 1 shows a propulsion unit according to an embodiment of the invention. The propulsion unit 20 comprises a hollow support strut 21, a casing 22, a first electric motor 30, a first shaft 31, a hub 40, a propeller 50, and an annular nozzle 60 surrounding the propeller 50. The propeller 50 is pulling the vessel forwards in a first direction S1 i.e. a driving direction of the vessel. If the vessel is desired to be driven to an opposite direction, the azimuthing propulsion unit may be rotated 180 degrees whereby the propulsion unit still operates in a pulling mode. The propeller is thus designed and optimised for operation in a primary rotation direction.

In some situations, such as emergency situations for example, the orientation of the propulsion unit may be maintained but the rotation direction of the propeller may be reversed for breaking of the vessel and/or driving the vessel backwards. In this mode the propeller operates by pushing water ahead of the propeller. Such operation is, however, temporary and the propeller is not optimized for such operation.

The support strut 21 extends downwards from a hull 10 of a vessel. An upper end 21A of the strut 21 extends into the interior of the hull 10 of the vessel and is rotatably supported at a bottom portion of the hull 10 of the vessel. The support strut 21 has further a leading edge 21C facing towards the driving direction S1 of the vessel. The casing 22 is attached to a lower end 21B of the strut 21. The casing 22 has the form of a gondola having a first end 22A and a second opposite end 22B. The gondola may have at least substantially a form of a drop, whereby the first end 22A, that is the front end, may be more blunt than the second end 22B being the aft end of the pod. The casing/pod is thus arranged for propagation/driving the blunt head 22A ahead for minimization of water resistance. The first end 22A of the casing 22 is directed towards the driving direction S1 of the vessel when the vessel is driven forwards.

The hub 40 is connected to the first end 22A of the casing 22 and the propeller 50 is attached to the hub 40. A first end 31A of the first shaft 31 is connected to the first electric motor 30 positioned within the casing 22 and a second end 31B of the first shaft 31 is connected to the hub 40. The hub 40 and thereby also the propeller 50 rotates with the first shaft 31 driven by the first electric motor 30. The first shaft 31 rotates around a shaft line X-X.

The propeller 50 comprises at least three radially extending blades 51, 52, advantageously three to seven blades 51, 52. The water enters the blades 51, 52 of the propeller 50 directly without any disturbing elements positioned before the propeller 50. There are thus no vanes, for instance, in front of the pulling propeller in the driving direction whereby the water is allowed to enter the blades of the propeller freely. The blades 51, 52 of the propeller 50 are dimensioned according to normal marine propeller dimensioning processes. The blade 51, 52 geometry of the propeller 50 is optimized for the freely incoming three dimensional water flow taking into account the downstream equipment such as the support construction 70 of the nozzle 60 and the support strut 21.

The annular nozzle 60 surrounds an outer perimeter of the propeller 50 blades 51, 52. The shaft line X-X forms also an axial centre line for the annular nozzle 60. In an advantageous embodiment, the centre of the propeller in the longitudinal direction of the nozzle 60 is in a range from 0.30 to 0.45 times the diameter of the propeller 50 from the inlet opening 61 of the nozzle 60.

The annular nozzle 60 has an inlet opening 61 and an outlet opening 62, whereby a central duct 65 is formed between the inlet opening 61 and the outlet opening 62 of the nozzle 60. The central duct 65 forms an axial flow path for water flowing through the interior of the annular nozzle 60. The shape of the nozzle 60 is designed for minimal self-induced drag and for maximal thrust. The length, the thickness and the position of the nozzle 60 in relation to the casing 22 has to be optimized. In one advantageous embodiment, the length of the nozzle 60 is between a range being between from 0.45 to 0.65 times the diameter of the propeller 50. In a further advantageous embodiment, the length of the nozzle is 0.45 to 0.55 times the diameter of the propeller. The angle of the front end 22A of the casing 22 has a great effect on the form of the nozzle 60. This will in more detailed be explained with reference to FIGS. 4A to 7.

The annular nozzle 60 is fixedly attached to the casing 22 with a support construction 70 comprising radially extending vanes 71, 72 extending between the outer perimeter of the casing 22 and the inner perimeter of the nozzle 60. There are at least three vanes 71, 72, advantageously two to seven vanes 71, 72 supporting the annular nozzle 60 at the casing 22.

The number of propeller blades and the vanes may be mutually different to avoid non-stationary forces. In some embodiments, the stator may have more vanes than the rotor has blades. In some embodiments, the difference is one (1), that is, the stator has one vane more than the rotor has blades. In an embodiment, the propeller may have four blades and the stator five vanes.

The vanes 71, 72 are positioned after the propeller 50 in the driving direction S1 of the vessel. The rotating propeller 50 causes water to flow through the central duct 65 from the first end 61 of the central duct 65 to the second end 62 of the central duct 65 in a second direction S2, which is opposed to the first direction S1 i.e. the driving direction of the vessel. The thrust produced by the propeller 50 is amplified by the annular nozzle 60. The propeller 50 is thus pulling the vessel in the first direction S1.

The vanes 71, 72 of the support construction 70 receive the spiral shaped water flow from the blades 51, 52 of the propeller 50 as the vanes 71, 72 are positioned after the propeller 50 in the driving direction S1 of the vessel 10. The vanes 71, 72 recover the rotational energy created by the blades 51, 52 of the propeller 50. The vanes 71, 72 redirect the rotational flow component of the spiral shaped water flow into the axial direction. This will increase the thrust produced by the propeller 50.

The sectional shape of the vanes 70 is designed to minimize self-induced drag. Each vane 71, 72 is designed by taking into account the incoming three dimensional water flow i.e. the water flow coming from the propeller 50. The impact of the support strut 21, which is positioned downstream from the vanes 71, 72 is also taken into consideration when designing the vanes 71, 72.

The vanes 71, 72 in the support construction 70 are optimized for redirecting rotational flow components of the flow produced by the propeller 50 into axial thrust. The optimization is done by calculating the flow field produced by the propeller 50 just before the support construction 70. The calculation can be done by computational fluid dynamics (CFD) or by a more simple panel method. When the flow field is known, then the optimal angle distribution in the radial direction of the vanes 71, 72 in relation to the incoming flow is determined so that the ratio between the extra thrust that the vanes 71, 72 produce and the self-induced drag that the vanes 71, 72 produce is maximized. The ratio between the thickness and the length of each vane 71, 72 is determined by the strength of the vanes 71, 72. The vanes 71, 72 carry and supply the thrust and the hydrodynamic loads produced by the propeller 50.

In the embodiments, the propeller thus produces a rotational torque to the water entering freely/directly to the propeller. After the propeller in the driving direction, the rotating water flow enters the vanes, which produce an opposite torque than the propeller to the water flow. Thereby an axial flow of water is returned by the vanes. The vanes thus compensate for the rotational torque produced by the propeller by an opposite torque to return the rotating water flow entering the vanes to an axial thrust when the water exits the vanes and the nozzle. It may thus be said that the vanes impart a counter-torque to the water flow when compared to the torque imparted by propeller, which counter-torque at least substantially equalizes the rotational effect of the propeller such that as an outcome a direct water flow is provided by the nozzle. It is advantageous that the vanes are positioned interior of the nozzle, that is between the inlet and outlet openings of the nozzle. In this way the axial flow of the water is returned as soon as possible which maximizes the thrust obtained from the nozzle.

The propeller 50 and the support construction 70 are fully within the nozzle 60 i.e. within the inlet end 61 and the outlet end 62 of the nozzle 60. That is, the propeller blades and the vanes are located inside a tube defined by the nozzle.

The upper end 21A of the support strut 21 is attached to a gear wheel 26 within the hull of the vessel. A second electric motor 110 is connected via a second shaft 111 to a pinion 112 being connected to the cogs of the turning wheel 26. The second electric motor 110 will thus turn the gear wheel 26 and thereby also the propulsion unit 20. The propulsion unit 20 is thus rotatable supported at the hull 10 of the vessel and can be rotated 360 degrees around a vertical centre axis Y-Y in relation to the hull 10 of the vessel. The figure shows only one second electric motor 110 connected to the gear wheel 26, but there could naturally be two or more second electric motors 110 driving the gear wheel 26.

The electric power needed in the electric motors 30, 110 is produced within the hull 10 of the vessel. The electric power can be produced by a generator connected to a combustion engine. The electric power to the first electric motor 30 is supplied by cables running from the generator within the interior of the hull 10 of the vessel to the propulsion unit 20. A slip ring arrangement 100 is needed in connection with the gear wheel 26 within the hull 10 in order to transfer electric power from the stationary hull 10 to the rotatable propulsion unit 20.

The centre axis X of the first shaft 31 is directed in the horizontal direction in the embodiment shown in the figures. The centre axis X of the first shaft 31 could, however, be inclined in relation to the horizontal direction. The casing 22 would thus be inclined in relation to the horizontal direction. This might in some circumstances result in hydrodynamic advantages.

The angle $\alpha 1$ between the axis Y-Y of rotation of the propulsion unit 20 and shaft line X-X is advantageously 90 degrees, but it could be less than 90 degrees or more than 90 degrees.

Figure 2:
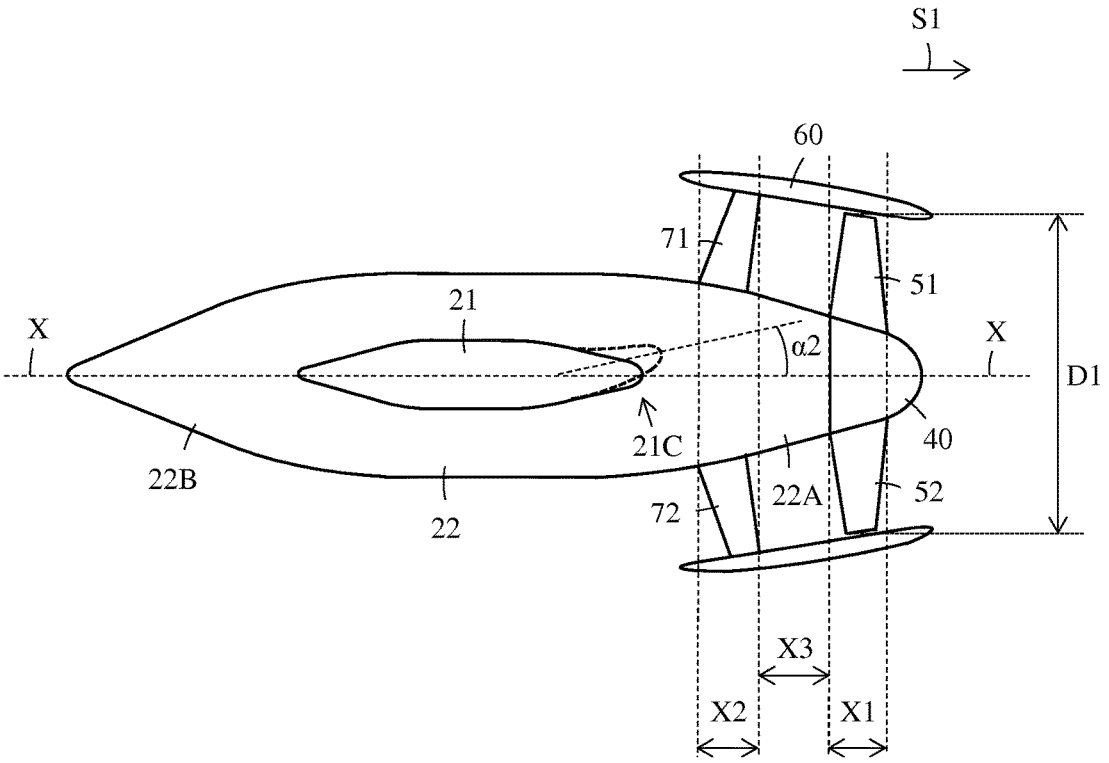
FIG. 2 shows a horizontal cross section of a propulsion unit according to the invention.

FIG. 2 shows a horizontal cross section of a propulsion unit according to the invention. The figure shows the support strut 21 and the casing 22. The support strut 21 supports the propulsion unit 20 at the hull of the vessel. The horizontal cross section of the support strut 21 shows that the leading edge 21C of the support strut 21 is inclined by an angle $\alpha 2$ towards the incoming water flow. The leading edge 21C of the support strut 21 can be optimized and shaped to increase the thrust of the whole unit by inclining the leading edge 21C towards the incoming water flow. The support strut 21 can thus recover the remaining rotational energy from the three dimensional flow after the support construction 70. The inclination angle $\alpha 2$ of the leading edge 21C of the support strut 21 varies in the range of 0 to 10 degrees. In an advantageous embodiment, the inclination angle is in a range of 3 to 7 degrees. Preferably, the inclination is towards an approaching rotor blade. That is, if the rotor rotates clockwise, the inclination points to the right when seen from the behind of the strut. The inclination angle $\alpha 2$ of the leading edge 21C of the support strut 21 can vary in the radial direction. The angle of the water flow after the support construction 70 of the nozzle 60 can be calculated by computational fluid dynamics (CFD) or by a more simple panel method in order to determine the angle $\alpha 2$.

The blades 51, 52 of the propeller 50 are positioned in a first axial zone X1 and the vanes 71, 72 of the support construction 70 are positioned in a second axial zone X2. The second axial zone X2 is positioned at an axial distance X3 after the first axial zone X1 in the normal direction S1 of travel of the vessel.

The propeller 50 has a diameter D1 measured from a circle passing through the radial outer edges of the blades 51, 52 of the propeller 50.

Figure 3:
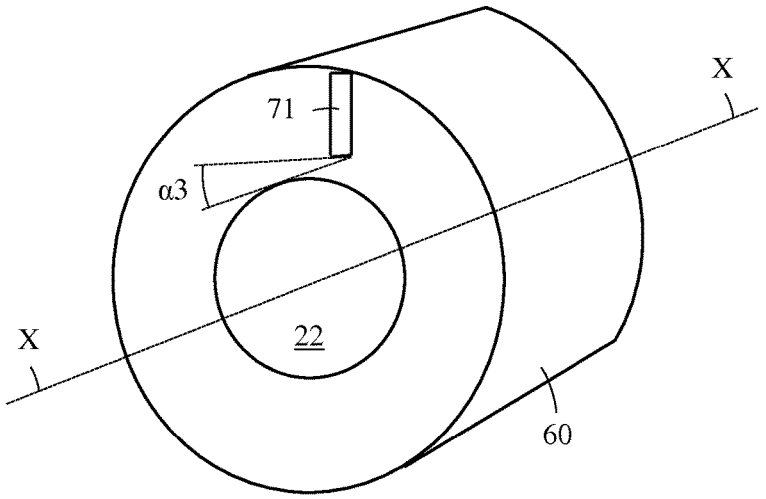
FIG. 3 shows an axonometric view of a part of the propulsion unit.

FIG. 3 shows an axonometric view of a part of the propulsion unit. The figure shows the casing 22 and the nozzle 60 surrounding the casing 22. The figure shows further one vane 71. The section angle $\alpha 3$ of each vane 71, 72 varies in the radial direction from 0 to 15 degrees. In one preferred embodiment, the angle is from 3 to 10 degrees. The section angle $\alpha 3$ is the angle between the axial direction X-X and the radial direction of the plane of the vane 71, 72. In other words, this angle defines how much the vane is inclined with respect to the longitudinal axis X-X, which also defines the rotation axis of the propeller.

Figure 4A:
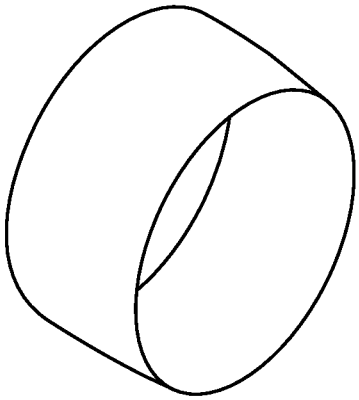
FIG. 4A shows an embodiment of a nozzle.

FIG. 4A shows a 3D-representation of one embodiment of a nozzle. The nozzle may thus be geometrically a cylinder or a cone frustum having open ends. The form of the nozzle may depend on the form of the pod surrounded by the nozzle. Preferably the open area between the pod and the nozzle is greater in the front of the nozzle than in the stern of the nozzle. The front of the nozzle refers to the end of the nozzle that is closer to the propeller to be placed within the nozzle. In another embodiment, the diameters of both ends of the nozzle are substantially equal.

Figure 4B:
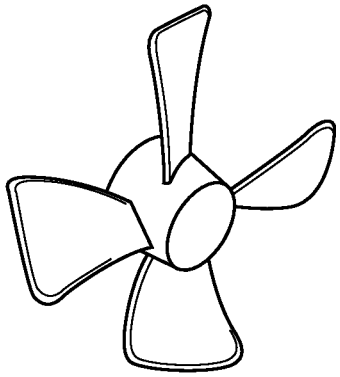
FIG. 4B shows an embodiment of a rotor.

FIG. 4B shows 3D-representation of an embodiment of a rotor/propeller. It can be seen that the propeller comprises a substantially cylindrical middle portion, rotor disk, to which the blades are fixed. The base portion of the blades which is fixed to the rotor disk may be slightly tilted from the rotation axis of the propeller. The form of the blade may further have a twisted form such that at the tip of the blade, the rear end is radially further away from the base of the blade than the front end of the blade.

Figure 4C:
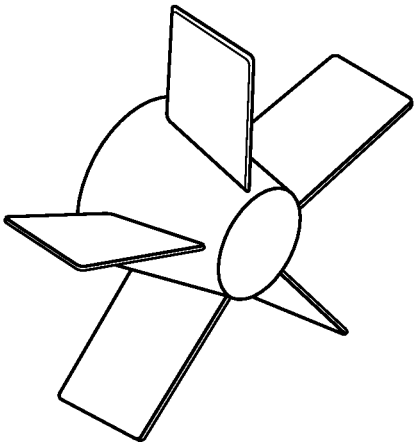
FIG. 4C shows an embodiment of a stator.

FIG. 4C shows a 3D-representation of an embodiment of a stator. The vanes of the stator may also be inclined with respect to the rotation axis of the rotor. The tilting of the stator blades may be to opposite direction than the tilting of the rotor blades. For instance, as the rotor blades in FIG. 4B are tilted to the right when seen from the rear of the rotor, the stator blades of FIG. 4C may be tilted to the left meaning that the front end of the vane is more left than the rear end of the vane. The tilting of the vane may be up to 15 degrees when compared to the rotation axis of the rotor. Preferably the vane tilting is between 3 to 10 degrees from a longitudinal axis passing longitudinally through the pod.

As the inclinations of the rotor blades and stator vanes are to opposite directions, they cause substantially opposite rotation effect on the water. That is, the vanes are arranged to substantially cause an opposite rotation force on the water than the rotor blades, whereby the rotation effect of the rotor is substantially compensated by the stator such that the thrust that exits the stator is at least substantially axial.

Figure 5:
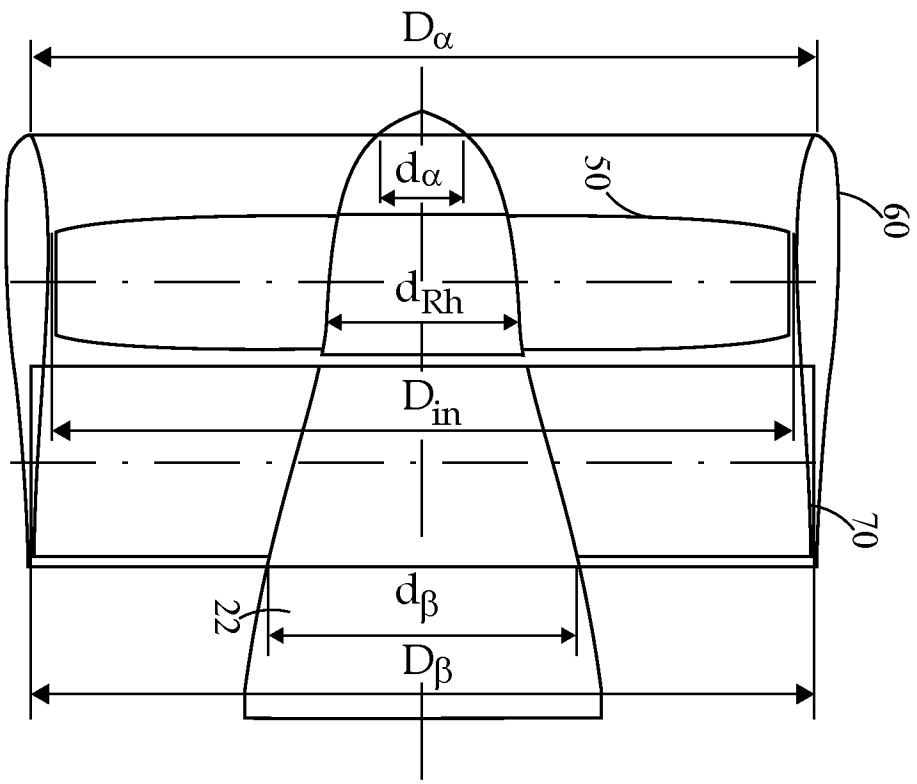
FIG. 5 illustrates exemplary dimensions of the pod unit and the nozzle.

FIG. 5 shows an embodiment of part of a propulsion unit for illustrating various dimensions and dependencies between dimensions. In FIG. 5, following abbreviations are used.

$D_\alpha$ is the diameter of the nozzle front in the principal propagation direction of the pod 22. $D_\beta$ is the diameter of the nozzle stern, that is, the end of the nozzle in the principal propagation direction of the pod 22. $d_\alpha$ refers to the diameter of pod at the plane of the nozzle front, and $d_\beta$ refers to the diameter of the pod on the plane of the nozzle stern. $D_{in}$ is the inner nozzle diameter on plane of the rotor disk to which the rotor blades are fixed to. $d_{Rh}$ refers to the diameter of the rotor hub.

Furthermore, following definitions are made.

$$\alpha = \frac{S_\alpha}{S_{in}},$$

where $S_\alpha$ is the section area of the nozzle front and $S_{in}$ is the section area of the nozzle at the rotor disk $$\beta = \frac{S_\beta}{S_{in}},$$

where $S_\beta$ is the section area of the nozzle stern and $S_\beta$ $$S_\alpha = \frac{\pi}{4}(D_\alpha^2 - d_\alpha^2),$$

$$S_\beta = \frac{\pi}{4}(D_\beta^2 - d_\beta^2),$$

$$S_{in} = \frac{\pi}{4}(D_{in}^2 - d_{in}^2),$$

$$\alpha = \frac{D_\alpha^2 - d_\alpha^2}{D_{in}^2 - d_{in}^2},$$

$$\beta = \frac{D_\beta^2 - d_\beta^2}{D_{in}^2 - d_{in}^2}.$$

Figure 6:
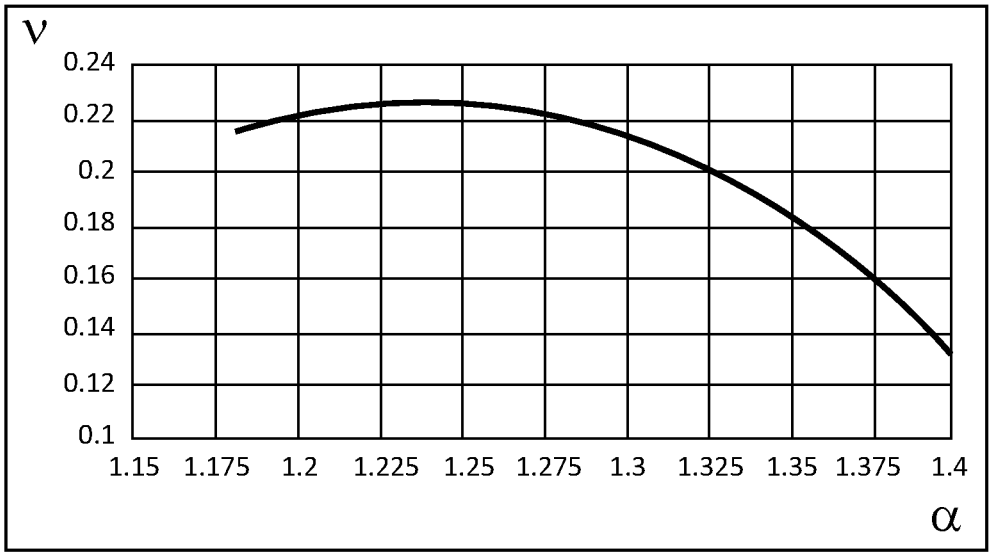
FIG. 6 shows a dependency between nozzle dimensions and thrust efficiency.

FIG. 6 shows a relationship between $\alpha$ and the thrust $\nu$ produced by the propeller. It can be seen that the thrust is maximized when $\alpha$, which is illustrative of a division between the open water flow area at the front head of the nozzle and the open water area at the rotor disk, is approximately 1.25. An optimum range can be defined to be between 1.15 to 1.35, even more preferably between 1.20 to 1.30. Thrust here illustrates how great force is affected on the area covered by the propeller.

Figure 7:
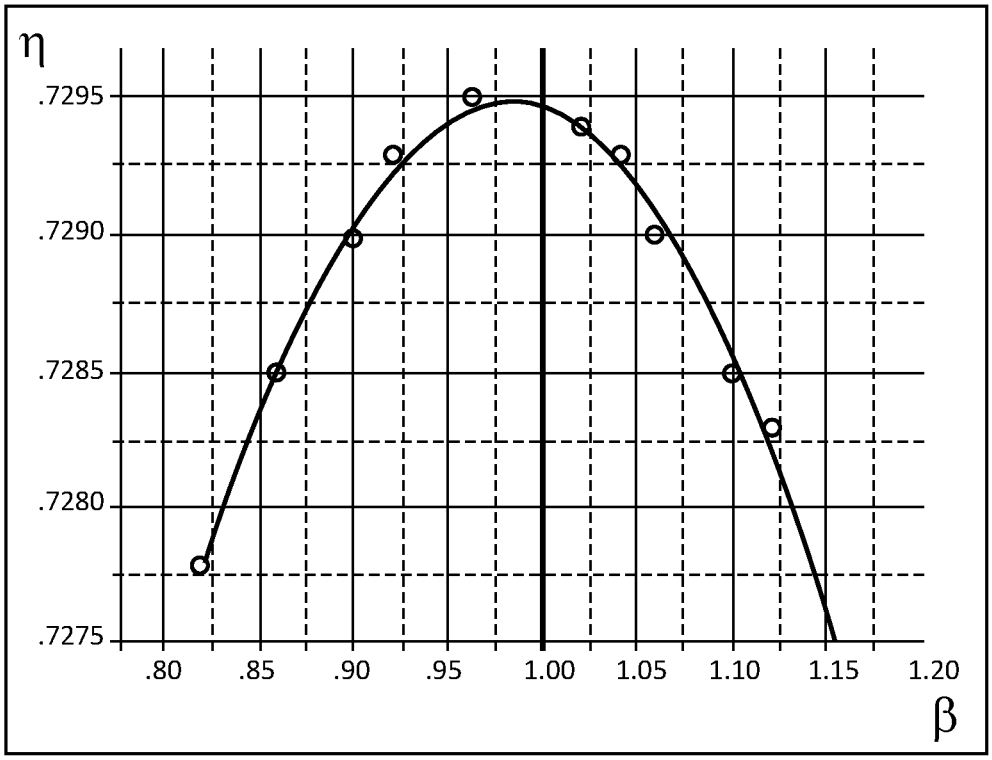
FIG. 7 shows another dependency between nozzle dimensions and thrust efficiency.

FIG. 7 shows a relationship between $\beta$, which refers to open area at the stern of the nozzle divided by the open area at the rotor disk, and efficiency $\eta$ produced by the propeller. It can be seen that a slight improvement in efficiency is achieved when $\beta$ is under 1.10, especially between 1.00 and 1.10.

The invention and its embodiments are not limited to the examples described above but may vary within the scope of the claims.

The invention claimed is:

1. A propulsion unit for a vessel, comprising:

a support strut extending downwards from a hull of the vessel, a casing attached to a lower end of the support strut, the casing comprising a first end and a second end, the first end facing a front end of the vessel and the second end facing an aft end of the vessel, a propeller being arranged at the first end of the casing, the propeller rotates in a first direction to pull the vessel in a driving direction toward the front end of the vessel and rotates in a second direction to push the vessel in a reverse direction toward the aft end of the vessel, wherein the propeller is defined by a geometry optimized for rotation in the first direction relative to the second direction, an annular nozzle surrounding an outer perimeter of propeller blades and the annular nozzle being fixedly supported on the casing with a support construction comprising at least three vanes, said annular nozzle having an inlet opening and an outlet opening, whereby a duct for water flow is formed between the inlet opening and the outlet opening through an interior of the annular nozzle, the propeller pulls the vessel in the driving direction, the water flow enters the propeller blades of the propeller freely from the inlet opening of the annular nozzle, the support construction is positioned between the propeller and the support strut in the driving direction of the vessel, and the vanes of the support construction are arranged between an outer perimeter of the casing and an inner perimeter of the annular nozzle to receive the water flow from the propeller blades of the propeller when the propeller rotates in the first direction to pull the vessel in the driving direction, wherein the vanes are disposed fully inside of the annular nozzle.

2. The propulsion unit according to claim 1, wherein an upper end of the support strut is rotatably supported at a bottom portion of the hull.

3. The propulsion unit according to claim 1, wherein the propulsion unit comprises a first electric motor positioned within the casing.

4. The propulsion unit according to claim 1, wherein the propulsion unit comprises a hub attached to the first end of the casing and the propeller is attached to the hub.

5. The propulsion unit according to claim 1, wherein the propulsion unit comprises a first shaft having a first end attached to a first electric motor and a second end attached to a hub.

6. The propulsion unit according to claim 1, wherein the vanes in said support construction are configured to redirect rotational flow components of a rotational flow produced by the propeller into an axial thrust.

7. The propulsion unit according to claim 1, wherein the vanes in said support construction are configured to compensate for a rotational effect caused by the propeller so that flow after the vanes is returned to an axial thrust.

8. The propulsion unit according to claim 1, wherein the vanes in said support construction are arranged to extend in a radial direction of the annular nozzle.

9. The propulsion unit according to claim 1, wherein a number of the vanes in the support structure is greater than a number of the propeller blades in the propeller.

10. The propulsion unit according to claim 1, wherein the first end of the casing has a more blunt form than the second end whereby the casing is configured for propagation in the driving direction with the first end being ahead.

11. The propulsion unit according to claim 10, wherein a first end of the support strut has a more blunt form than a second end whereby the support strut is configured for propagation in the driving direction with the first end being ahead.

12. The propulsion unit according to claim 1, wherein the propulsion unit comprises a gearing assembly for receiving propulsion power from a motor external to the casing.

13. The propulsion unit according to claim 1, wherein a length of the annular nozzle is in a range from 0.45 to 0.65 times a diameter of the propeller.

14. The propulsion unit according to claim 1, wherein a center of the propeller in a longitudinal direction of the annular nozzle is in a range from 0.30 to 0.45 times a diameter of the propeller from the inlet opening of the annular nozzle.

15. The propulsion unit according to claim 1, wherein the support structure comprises 3 to 7 vanes.

16. The propulsion unit according to claim 1, wherein a leading edge of the support strut is inclined by an angle towards an incoming water flow, said angle of the leading edge of the support strut being in the range of 3 to 7 degrees.

17. The propulsion unit according to claim 1, wherein an inclination angle of at least one vane with respect to a rotation axis of the propeller is between 3 to 10 degrees.

18. The propulsion unit according to claim 1, wherein a section area between a pod and the annular nozzle at the front of the annular nozzle is 1.15 to 1.35 times a section area between a rotor disk and the annular nozzle.

19. The propulsion unit according to claim 1, wherein a section area between a pod and an inner surface of the annular nozzle at a rear of the annular nozzle is 1.00 to 1.15 times a section area between a rotor disk and the annular nozzle.

20. The propulsion unit according to claim 1, wherein the propeller comprises a cylindrical middle portion, a rotor disk, to which the propeller blades are fixed, and a base portion of each of the propeller blades which is fixed to the rotor disk is tilted from a rotation axis of the propeller, and a form of each of the propeller blades has a twisted form such that at a tip of each of the propeller blades, a rear end is radially further away from the base portion of the propeller blade than a front end of the propeller blade.

21. The propulsion unit according to claim 1, wherein the vanes are inclined with respect to a rotation axis of a rotor disk, which tilting of the vanes is to an opposite direction than a tilting of the propeller blades.

22. The propulsion unit according to claim 1, wherein the vanes in said support construction are inclined in an opposite direction relative to the propeller blades.

23. The propulsion unit according to claim 1, wherein a first end of the support strut has a more blunt form than a second end whereby the support strut is configured for propagation in the driving direction with the first end being ahead.

* * * * *